US009242829B2

(12) United States Patent
Miyajima

(10) Patent No.: US 9,242,829 B2
(45) Date of Patent: Jan. 26, 2016

(54) SHEET STACKING APPARATUS, METHOD FOR CONTROLLING THE SAME, AND STORAGE MEDIUM

(71) Applicant: CANON KABUSHIKI KAISHA, Tokyo (JP)

(72) Inventor: Jun Miyajima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/552,462

(22) Filed: Nov. 24, 2014

(65) Prior Publication Data

US 2015/0145201 A1 May 28, 2015

(30) Foreign Application Priority Data

Nov. 28, 2013 (JP) ..... 2013-246173

(51) Int. Cl.

| | |
|---|---|
| ***B65H 43/06*** | (2006.01) |
| ***B65H 31/18*** | (2006.01) |
| ***B65H 31/10*** | (2006.01) |
| ***B65H 43/00*** | (2006.01) |
| ***B65H 31/04*** | (2006.01) |
| ***B65H 31/30*** | (2006.01) |
| ***B65H 31/08*** | (2006.01) |

(52) U.S. Cl.

CPC ..... *B65H 43/06* (2013.01); *B65H 31/04* (2013.01); *B65H 31/08* (2013.01); *B65H 31/10* (2013.01); *B65H 31/18* (2013.01); *B65H 31/30* (2013.01); *B65H 43/00* (2013.01)

(58) Field of Classification Search

CPC ..... B65H 31/10; B65H 31/18; B65H 31/08; B65H 31/04; B65H 43/00; B65H 43/06; B65H 43/04

See application file for complete search history.

(56) References Cited

U.S. PATENT DOCUMENTS

2011/0031678 A1* 2/2011 Iizuka ..... 271/3.16

FOREIGN PATENT DOCUMENTS

JP 2001-226022 A 8/2001

* cited by examiner

*Primary Examiner* — Luis A Gonzalez

(74) *Attorney, Agent, or Firm* — Canon USA, Inc. IP Division

(57) ABSTRACT

A sheet stacking apparatus includes a lowering control unit, a determination unit, a notification unit, and a control unit. The lowering control unit lowers a discharge tray based on an amount of sheets discharged to the tray. The determination unit can determine that lowering of the discharge tray has been disabled before the discharge tray reaches a lower end position. The notification unit notifies removal of an object present below the discharge tray when it is determined that the lowering of the discharge tray has been disabled. The control unit executes control so as to raise the discharge tray in response to the determination that the lowering of the discharge tray has been disabled.

8 Claims, 11 Drawing Sheets

SHEET STACKING APPARATUS, METHOD FOR CONTROLLING THE SAME, AND STORAGE MEDIUM

BACKGROUND OF THE INVENTION

1. Field of the Invention

The present invention relates to a sheet stacking apparatus, a method for controlling the same, and a storage medium.

2. Description of the Related Art

There is conventionally a sheet stacking apparatus that includes a stacking tray for stacking sheets and lowers a discharge tray according to the stacked amount of sheets to be discharged.

Specifically, as illustrated in FIG. 11A, the discharge tray is lowered in response to discharging and stacking of sheets on the discharge tray. After a sheet bundle has been removed, the discharge tray is raised to a normal position. On the other hand, as illustrated in FIG. 11B, when the discharge tray is at the normal position (state illustrated in FIG. 11A), a space is present below the discharge tray. However, as illustrated in FIG. 11B, when an obstacle is located below the discharge tray, the discharge tray may collide with the obstacle while sheets are discharged to the tray. Therefore, there is known a method for detecting such a state, in which the obstacle prevents the discharge tray from lowering, and stopping the sheet discharging to the discharge tray or the lowering of the discharge tray to display a warning on an operation unit (as discussed in Japanese Patent Application Laid-Open No. 2001-226022).

As discussed in Japanese Patent Application Laid-Open No. 2001-226022, after the warning has been displayed to a user, the user may try to remove the obstacle. However, the discharge tray and the obstacle are kept in a contact state because the lowering of the discharge tray has been interrupted by the obstacle. When the user tries to remove the obstacle in this state, a load is applied to the obstacle or the discharge tray. There is a possibility that the obstacle may be deformed or the discharge tray may be destroyed.

SUMMARY OF THE INVENTION

According to an aspect of the present invention, a sheet stacking apparatus includes a lowering control unit configured to lower a discharge tray based on an amount of sheets discharged to the tray, a determination unit configured to determine that lowering of the discharge tray has been disabled before the discharge tray reaches a lower end position, a notification unit configured to notify removal of an object present below the discharge tray when it is determined that the lowering of the discharge tray has been disabled, and a control unit configured to execute control so as to raise the discharge tray in response to the determination that the lowering of the discharge tray has been disabled.

When a sheet discharging unit fails to move downward due to an object, the sheet discharging unit is moved such that the object is easily removed by a user. Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

<System Configuration>

Figure 1:
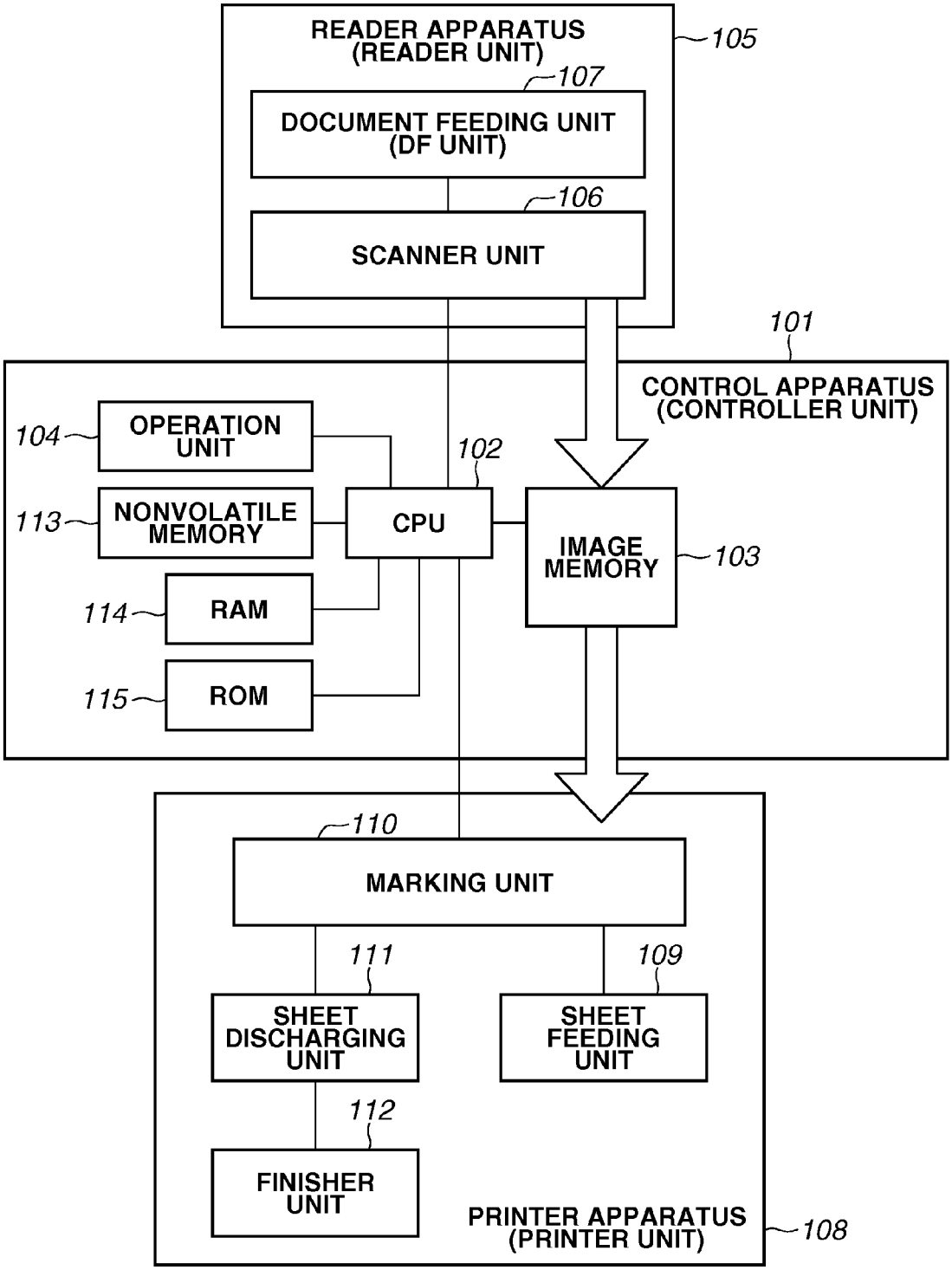
FIG. 1 is a block diagram illustrating a configuration of a printing system in which a printing apparatus is employed.

FIG. 1 is a block diagram illustrating a printing apparatus as an example of a sheet stacking apparatus according to a first exemplary embodiment. The present exemplary embodiment is directed to a system that performs printing by connecting a reader unit 105, a sheet discharging unit 111, and a finisher unit 112 to a printer unit 108 serving as the printing apparatus. The reader unit 105 (image input apparatus) illustrated in FIG. 1 optically reads a document image to convert it into image data. The reader unit 105 includes a scanner unit 106 that has a function of reading a document, and a document feeding unit (DF unit) 107 that has a function of conveying a document sheet.

The printer unit (image output apparatus) 108 conveys a recording sheet, and prints the image data as a visible image thereon to discharge the sheet out of the apparatus. The printer unit 108 includes a sheet feeding unit 109 that includes a plurality of types of recording sheet cassettes, and a marking unit 110 that has a function of transferring and fixing the image data to the recording sheet. The printer unit 108 further includes the sheet discharging unit 111 that has a function of outputting a printed recording sheet to the outside of the machine, and the finisher unit 112 that performs staple processing and sort processing. A control apparatus 101 includes a central processing unit (CPU) 102, an image memory 103, a nonvolatile memory 113, a random access memory (RAM) 114, a read-only memory (ROM) 115, and an operation unit 104.

The control apparatus 101 is electrically connected to the reader unit 105 and the printer unit 108. The CPU 102 in the control apparatus 101 controls the reader unit 105 to read image data of a document into the image memory 103, and controls the printer unit 108 to output the image data from the image memory 103 to a recording sheet, thereby providing a copy function. Various types of adjustment values are stored in the nonvolatile memory 113, the RAM 114 is used as a work area of the CPU 102, and a control program of the CPU 102 is stored in the ROM 115.

The operation unit 104 includes a liquid crystal display unit, a touch panel input device pasted on the liquid crystal display unit, and a plurality of hard keys. A signal input by the touch panel or the hard key is transmitted to the CPU 102, and a function display or the image data in the operation of this image forming apparatus is displayed on the liquid crystal display unit.

Figure 2:
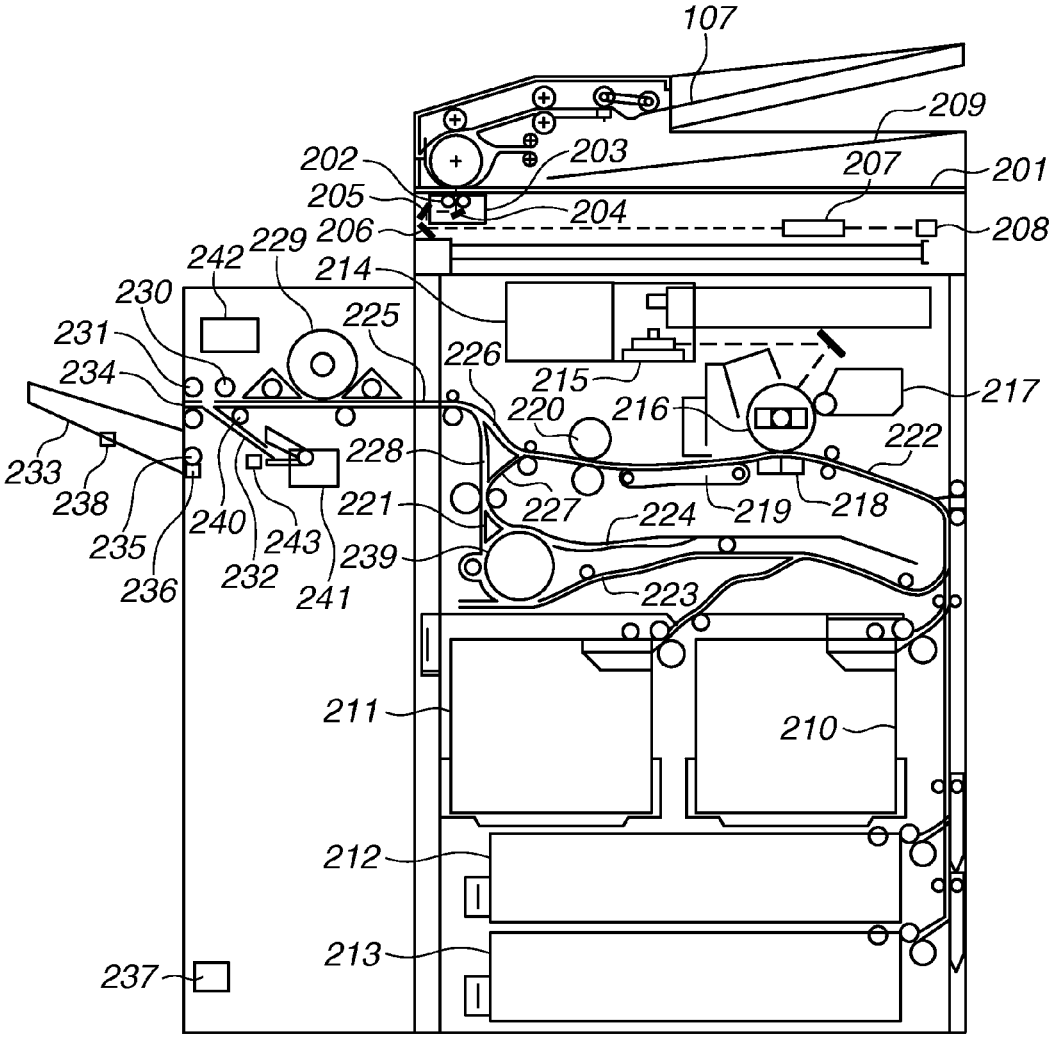
FIG. 2 is a sectional view illustrating a configuration of a reader unit and a printer unit illustrated in FIG. 1.

FIG. 2 is a sectional view illustrating a configuration of the reader unit 105 and the printer unit 108 illustrated in FIG. 1. In FIG. 2, in the reader unit 105, the document feeding unit (feeder) 107 is configured to feed documents one by one sequentially from a head onto a platen glass 201, and discharge the documents on the platen glass 201 to a discharge tray 209 after a document reading operation is ended.

After the documents have been conveyed onto the platen glass 201, a lamp 202 is lit, and movement of an optical unit 203 is started to expose and scan the documents. Light reflected from the documents at this time is guided to a charge-coupled device (CCD) image sensor (hereinafter, referred to as CCD) 208 through mirrors 204 to 206 and a lens 207. Accordingly, the images of the scanned documents are read by the CCD 208. Image data output from the CCD 208 is subjected to predetermined processing, and then transferred to the control apparatus 101.

In the printer unit 108, a laser driver 214 configured to drive a laser emission unit 215 causes the laser emission unit 215 to emit a laser beam according to the image data output from the control apparatus 101. This laser beam is irradiated to a photosensitive drum 216, and a latent image is formed on the photosensitive drum 216 according to the laser beam. A developer is stuck to the latent image portion of the photosensitive drum 216 by a developing device 217.

The printer unit 108 includes cassettes 210 to 213 that serve as the sheet feeding unit 109 and are each formed into a drawer shape. Sheets are replenished in such a manner that each sheet feeding cassette is drawn, sheets are supplied to the cassette, and then the cassette is closed.

The printer unit 108 feeds a recording sheet from one of the cassettes 210 to 213, and conveys the recording sheet through a conveyance path 222 to a transfer unit 218. The transfer unit 218 transfers the developer stuck to the photosensitive drum 216 to the recording sheet. The recording sheet bearing the developer is conveyed on a conveyor belt 219 to a fixing unit 220, and the developer is fixed on the recording sheet by heat and pressure of the fixing unit 220. Then, the recording sheet passed through the fixing unit 220 passes through a conveyance path 226 and a conveyance path 225 to be discharged. Alternatively, when the recording sheet is discharged by reversing its printing surface, the recording sheet is guided to a conveyance path 227 and a conveyance path 239. The recording sheet is conveyed in a reverse direction from there to pass through a conveyance path 228 and the conveyance path 225.

When two-sided recording is set, the recording sheet is guided from the conveyance path 227 to a conveyance path 224 by a flapper 221 after it has passed through the fixing unit 220. Then, the recording sheet is conveyed in a reverse direction, and guided to the conveyance path 239 and a sheet refeeding conveyance path 223 by the flapper 221. The recording sheet guided to the sheet refeeding conveyance path 223 passes through the conveyance path 222 at the aforementioned timing to be fed to the transfer unit 218. Irrespective of one-sided or two-sided recording, the recording sheet discharged from the conveyance path 225 is conveyed to the finisher unit 112.

The conveyed recording sheet is first fed to a buffer unit 229. Here, when necessary, the conveyed recording sheet is wound on a buffer roller to be subjected to buffering. For example, when processing such as stapling to be carried out on a downstream side takes time, a speed of the recording sheet conveyed from an apparatus body can be maintained constant by using the buffer unit 229, thereby contributing to improvement of throughput. Then, the recording sheet is conveyed through a conveyance path 234 by an upstream discharge roller pair 230 and a downstream discharge roller pair 231 to reach a discharge tray 233. In a staple mode, the recording sheet is conveyed by the upstream discharge roller pair 230 and, immediately after a rear end of the recording sheet is out of this path, the recording sheet is pulled back by a knurling belt 240 to reach a stack tray 232 functioning as a temporary storage unit.

After a predetermined number of recording sheets has been stacked, staple processing is performed by a staple unit 241, and then the recording sheets are discharged to the discharge tray 233 by the downstream discharge roller pair 231. During shift sorting, the sheets stacked on the stack tray 232 are shifted left and right, and discharged to the discharge tray 233, thereby representing sheet breaks. The stack tray 232 includes a stack sensor 243 for detecting the sheets on the stack tray 232.

In the finisher unit 112, the discharge tray 233 can be raised or lowered by a motor unit 235 constituting a movement unit according to the amount (sheet amount) of sheets discharged to be stacked on the discharge tray 233. The CPU 102 instructs the motor unit 235 to perform driving, and performs rising control or lowering control of the discharge tray 233 by causing the motor unit 235 to perform driving. Position information (sheet discharge position) of the discharge tray 233 after it is moved in the rising or lowering direction can be acquired by a position detection unit 236 constituting a detection unit. When the discharge tray 233 reaches a lower end of a movable range by a lowering operation, a lower end sensor 237 detects lower end reaching of the discharge tray 233. In the example illustrated in FIG. 2, an obstacle detection sensor 238 capable of detecting an obstacle (an object) below the discharge tray 233 is mounted on the discharge tray 233. However, this obstacle detection sensor 238 may not be mounted. The discharge tray 233 moves in a lower direction, and may stop moving downward before reaching a predetermined lower end position. This occurs in a case where an obstacle is present in a space below the discharge tray 233.

An upper end sensor 242 is present to determine whether the discharge tray 233 has reached an upper limit of the movable range by its rising operation. The upper end sensor 242 detects the upper limit including the sheets stacked on the discharge tray 233 while the lower end sensor 237 determines whether the discharge tray 233 has reached the lower end. In other words, when a great volume of sheets is stacked on the discharge tray 233, the upper end is detected by little rising. When no sheet is present on the discharge tray 233, the upper end is detected at a point of time when the discharge tray 233 reaches the upper end sensor 242.

Figure 3:
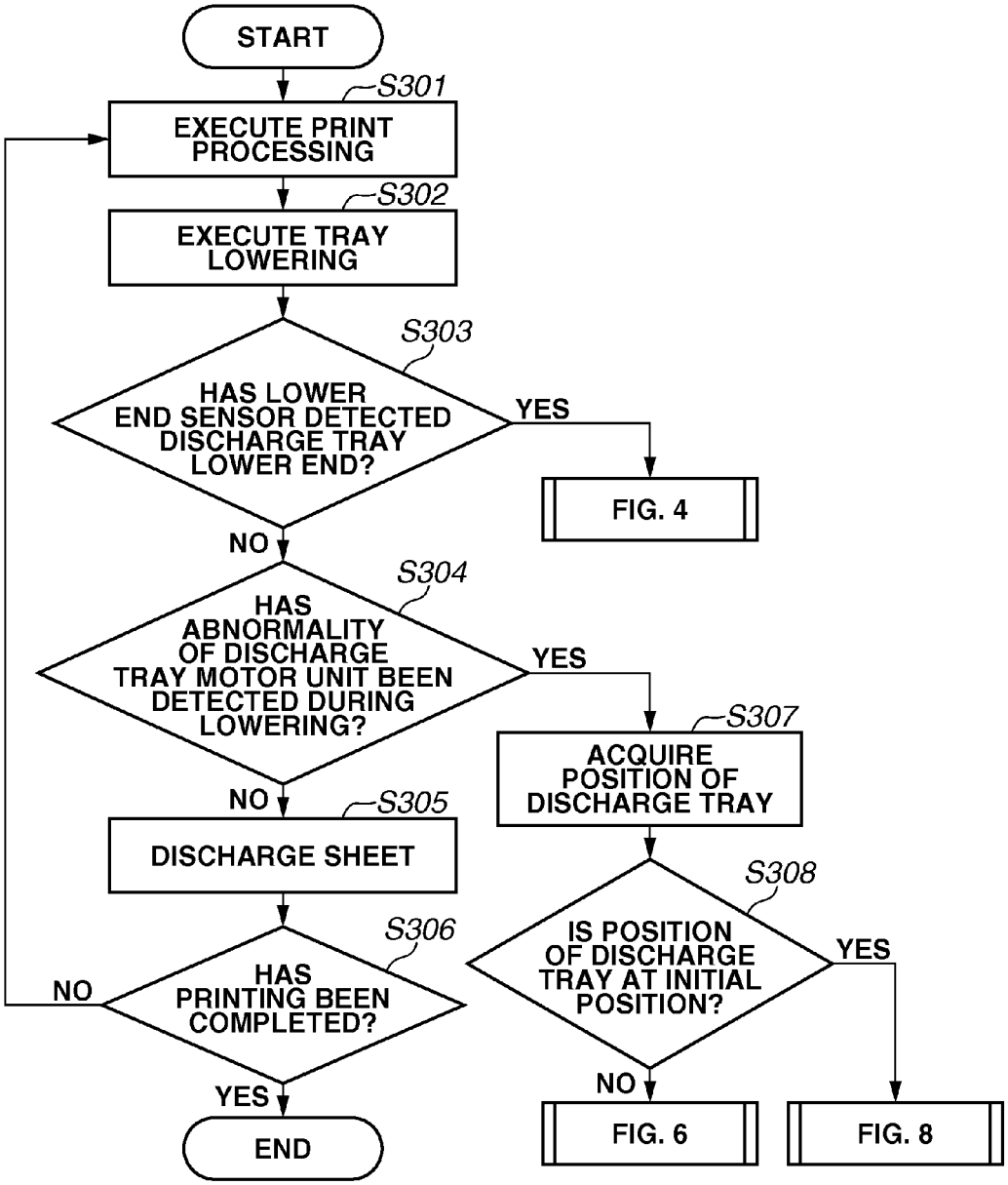
FIG. 3 is a flowchart illustrating a method for controlling the printing apparatus.

FIG. 3 is a flowchart illustrating a method for controlling the printing apparatus according to the present exemplary embodiment. This is an example where an error dealing process branches by detecting an error during lowering of the discharge tray 233 following print processing. Each step is achieved by executing a control program stored in the ROM or the like by the CPU 102.

When a print job is executed by the user, the CPU 102 executes this processing. The print job is a copy job executed from the operation unit 104 or a print job executed from a personal computer through a network. First, in step S301, the CPU 102 instructs the printer unit 108 to execute printing according to setting of the executed print job. In step S302, after the printing is completed, the CPU 102 instructs the motor unit 235 to lower the discharge tray 233 by a moving amount corresponding to the amount of sheets to be discharged. In step S303, after the discharge tray 233 has been lowered, the CPU 102 determines whether the lower end sensor 237 has detected lower end reaching of the discharge tray. When detected (YES in step S303), the CPU 102 proceeds to a flowchart illustrated in FIG. 4.

On the other hand, when the CPU 102 determines that the lower end sensor 237 has not detected predetermined lower end position reaching set for the discharge tray 233 (NO in step S303), the processing proceeds to step S304. When lower end position reaching is not detected the discharge tray 233 stops at a lowering position before reaching a predetermined lower end position. In step S304, the CPU 102 determines whether any motor abnormality has been detected during the lowering. When the CPU 102 determines that no pulse has been input even while the discharge tray 233 is lowered, the CPU 102 determines that the motor unit 235 is in an abnormal state (YES in step S304), and the processing proceeds to step S307. On the other hand, when the CPU 102 determines that no motor abnormality has been detected (NO in step S304), in step S305, printed sheets are discharged to the discharge tray 233. Then, in step S306, the CPU 102 determines whether printing of a total discharge sheets of the print job has been completed. When not completed (NO in step S306), in step S301, the CPU 102 continues printing thereafter. When completed (YES in step S306), the processing is ended.

When the CPU 102 determines that motor abnormality has been detected during the lowering of the discharge tray 233 (YES in step s304), in step S307, the CPU 102 acquires position information of the discharge tray 233 from the position detection unit 236. Then, in step S308, the CPU 102 determines whether a position of the discharge tray 233 is in an initial state. When the position of the discharge tray 233 is not in the initial state (NO in step S308), the CPU 102 determines that it is in a tray full state due to an obstacle, and the processing proceeds to a flowchart illustrated in FIG. 6. On the other hand, when the CPU 102 determines that the position of the discharge tray 233 is in the initial state (YES in step S308), the CPU 102 determines that removal of an obstacle occupying a region below the discharge tray 233 is necessary, and the processing proceeds to a flowchart illustrated in FIG. 8.

Figure 4:
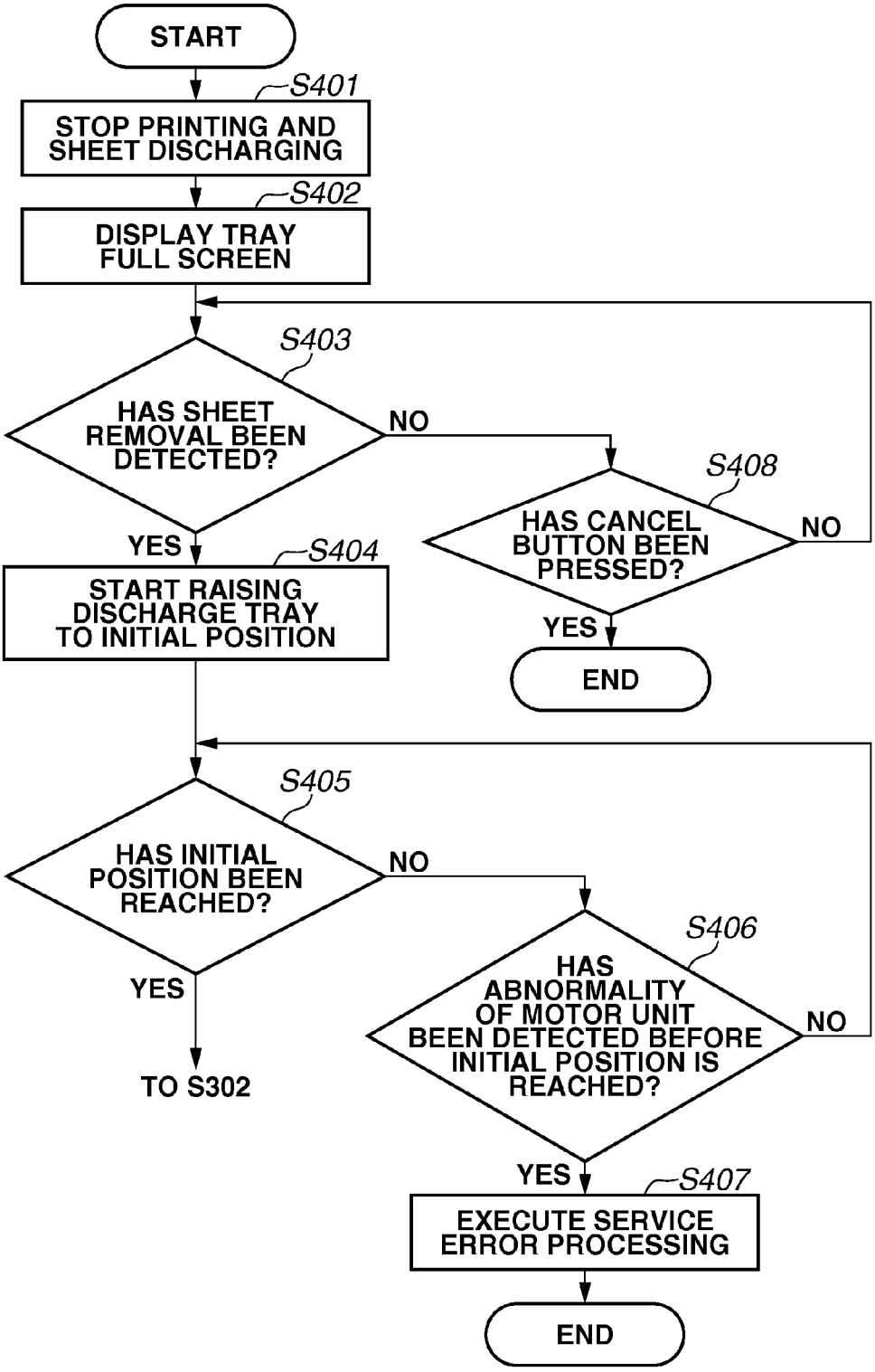
FIG. 4 is a flowchart illustrating the method for controlling the printing apparatus.

FIG. 4 is a flowchart illustrating the method for controlling the printing apparatus according to the present exemplary embodiment. This is a processing example executed when it is determined that no obstacle for blocking the rising/lowering operation of the discharge tray 233 is present in the region below the display tray 233 in the case of YES determination in step S303 illustrated in FIG. 3. Each step is achieved by executing a control program stored in the ROM or the like by the CPU 102. In step S401, after the discharge tray 233 has reached a lower end of a permitted region, the CPU 102 instructs the printer unit 108 to stop the printing and the sheet discharging operation. Then, in step S402, the CPU 102 controls the operation unit 104 to display a user interface screen for displaying, to the user, the lower end reaching of the discharge tray 233 or the removing of the sheets from the discharge tray 233. The present exemplary embodiment is directed to a case where a notification is issued to prompt the user to remove the discharged sheets by using the user interface screen.

Figure 5:
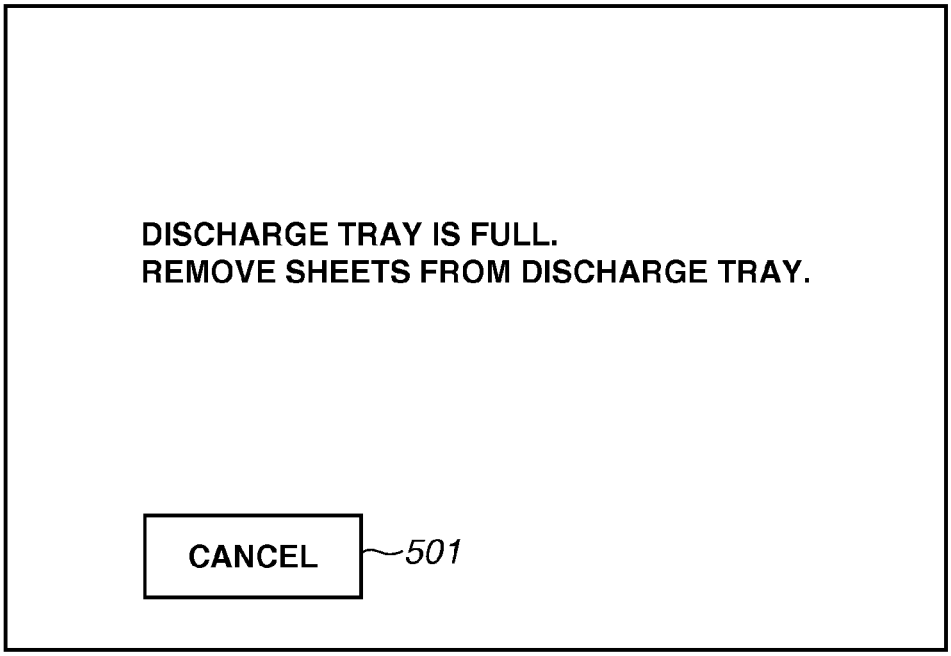
FIG. 5 is a diagram illustrating an example of a user interface (UI) screen displayed on an operation unit illustrated in FIG. 1.

FIG. 5 is a diagram illustrating an example of a UI screen displayed on the operation unit 104 illustrated in FIG. 1. This UI screen is an example of the user interface screen displayed in step S402, in other words, an example where as a message, the user is requested to remove a sheet bundle discharged to the discharge tray 233. On the UI screen, a cancel button 501 for canceling the print job is simultaneously displayed. After the notification is issued in step S402, in step S403, the CPU 102 determines whether the finisher unit 112 has detected that the user has removed the sheets from the discharge tray 233. When detected (YES in step S403), in step S404, the CPU 102 instructs the motor unit 235 to raise the discharge tray 233 to the initial state. Accordingly, in step S405, after the discharge tray 233 has reached the initial state, the CPU 102 returns to step S302. On the other hand, when the CPU 102 determines that the abnormality of the motor unit 235 has been detected before the discharge tray 233 reaches the initial state (YES in step S406), in step S407, the CPU 102 determines that there is an error in the sheet discharging unit, performs service error processing, and the processing is ended. When the user presses the cancel button 501 on the UI screen displayed on the operation unit 104 in step S402 (YES in step S408), the CPU 102 cancels the print job to end the processing.

Figure 6:
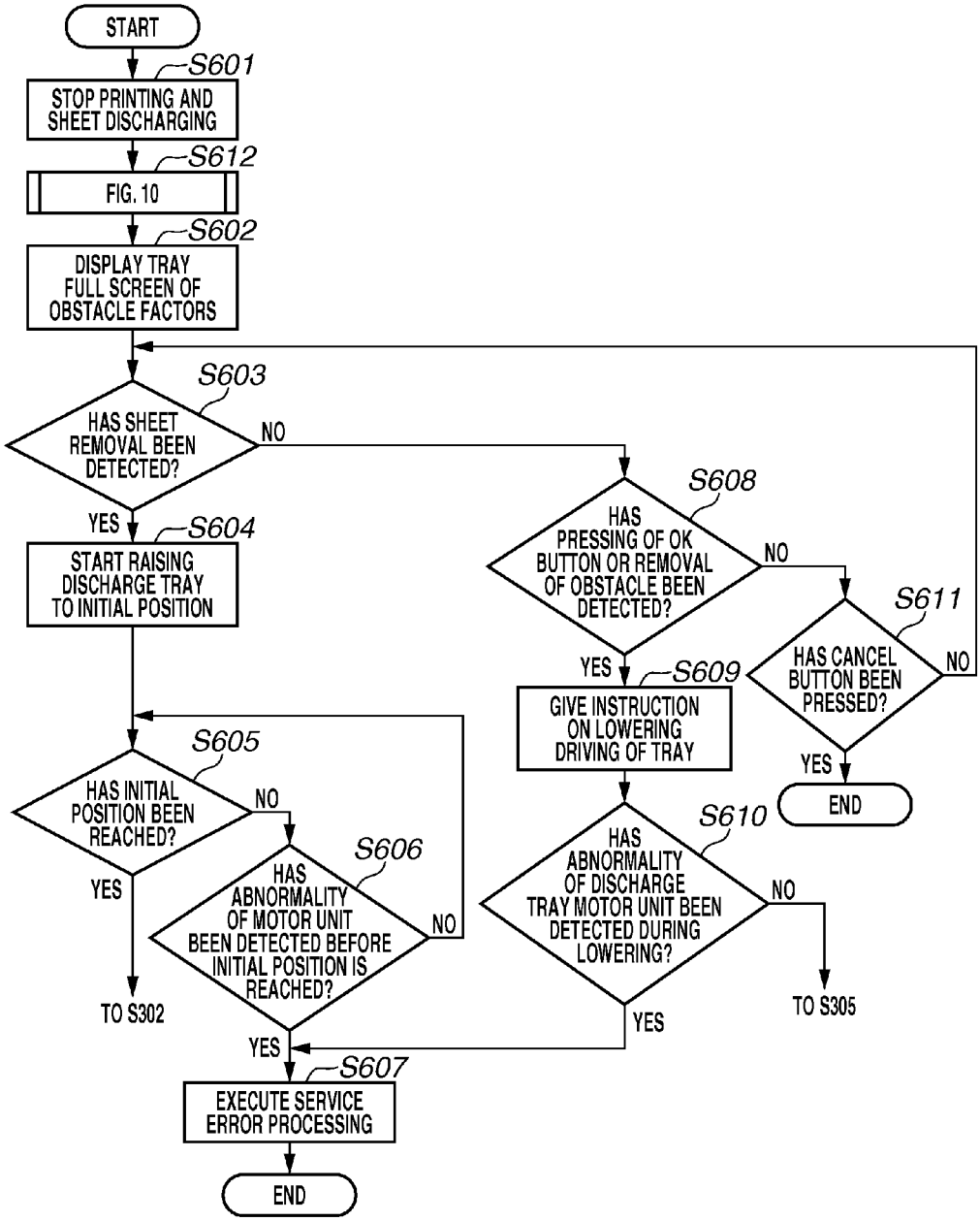
FIG. 6 is a flowchart illustrating the method for controlling the printing apparatus.

FIG. 6 is a flowchart illustrating the method for controlling the printing apparatus according to the present exemplary embodiment. This is a processing example executed when the CPU 102 determines that it is in the tray full state due to the obstacle, in step S308 illustrated in FIG. 3. Each step is achieved by executing a control program stored in the ROM or the like by the CPU 102. In step S601, after the CPU 102 determines that it is in the tray full state due to the obstacle, the CPU 102 instructs the printer unit 108 to stop the printing and the sheet discharging operation. Then, the CPU 102 proceeds to a flowchart (described in detail below) illustrated in FIG. 10, and in step S612, the CPU 102 gives an instruction to raise the discharge tray 233.

Then, in step S602, the CPU 102 controls the operation unit 104 to display the user interface screen for displaying, to the user, the removing of the sheets from the discharge tray 233 or the removing of the obstacle below the discharge tray 233.

Figure 7:
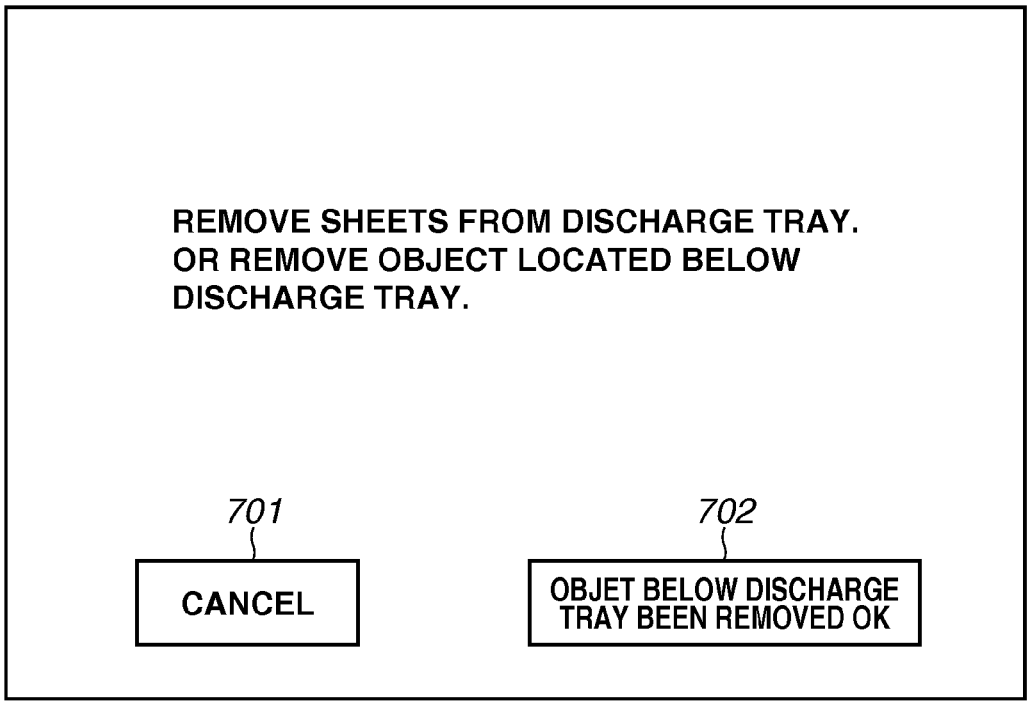
FIG. 7 is a diagram illustrating an example of the UI screen displayed on the operation unit illustrated in FIG. 1.

FIG. 7 is a diagram illustrating an example of the UI screen displayed on the operation unit 104 illustrated in FIG. 1. This UI screen is an example of the user interface screen displayed in step S602. A cancel button 701 and a remove button 702 pressed after an obstacle located in a space region below the discharge tray 233 is removed are shown on the UI screen. The UI screen is used for prompting the user to remove the obstacle located in the space region below the discharge tray 233. The remove button 702 is pressed after the user has removed the obstacle from the space region. By pressing the remove button 702, the CPU 102 can determine that the CPU 102 has received an instruction has been received which confirms removal of the obstacle. In step S603, the CPU 102 determines whether the finisher unit 112 has detected that the user has removed the sheets from the discharge tray 233. When detected (YES in step S603), in step S604, the CPU 102 instructs the motor unit 235 to raise the discharge tray 233 to the initial state. In step S605, after the discharge tray 233 has reached the initial state, the CPU 102 returns to step S302. On the other hand, when the CPU 102 determines that the abnormality of the motor unit 235 has been detected before the discharge tray 233 reaches the initial state (YES in step S606), in step S607, the CPU 102 determines that there is an error in the sheet discharging unit, performs service error processing, and the processing is ended.

Then, in step 608, when the CPU 102 determines that the user has removed the obstacle below the discharge tray 233 before removal of the sheets from the discharge tray 233 is detected (NO in step S603), the obstacle removal is detected by the obstacle detection sensor 238. When the CPU 102 determines that the obstacle removal has been detected (YES in step S608), in step S609, the CPU 102 gives an instruction to lower the discharge tray 233. When a finisher is connected on which the obstacle detection sensor 238 is not mounted, the user presses the remove button 702 on the user interface screen displayed in step S602 to announce to the CPU 102 that the removal of the obstacle has been confirmed. In step S609, the CPU 102 detects the pressing of the remove button 702 to give an instruction to lower the discharge tray 233.

When the CPU 102 determines that motor abnormality has been detected again after an instruction to lower the discharge tray 233 has been given (YES in step S610), in step S607, the CPU 102 determines that there is an error in the sheet discharging unit to execute service error processing. On the other hand, when the CPU 102 determines that no abnormality has been detected (NO in step S610), printed sheets are discharged to the discharge tray 233. When the CPU 102 determines that the user has pressed the cancel button 701 on the user interface screen displayed in step S602 (YES in step S611), the CPU 102 cancels the print job to end the processing.

Figure 8:
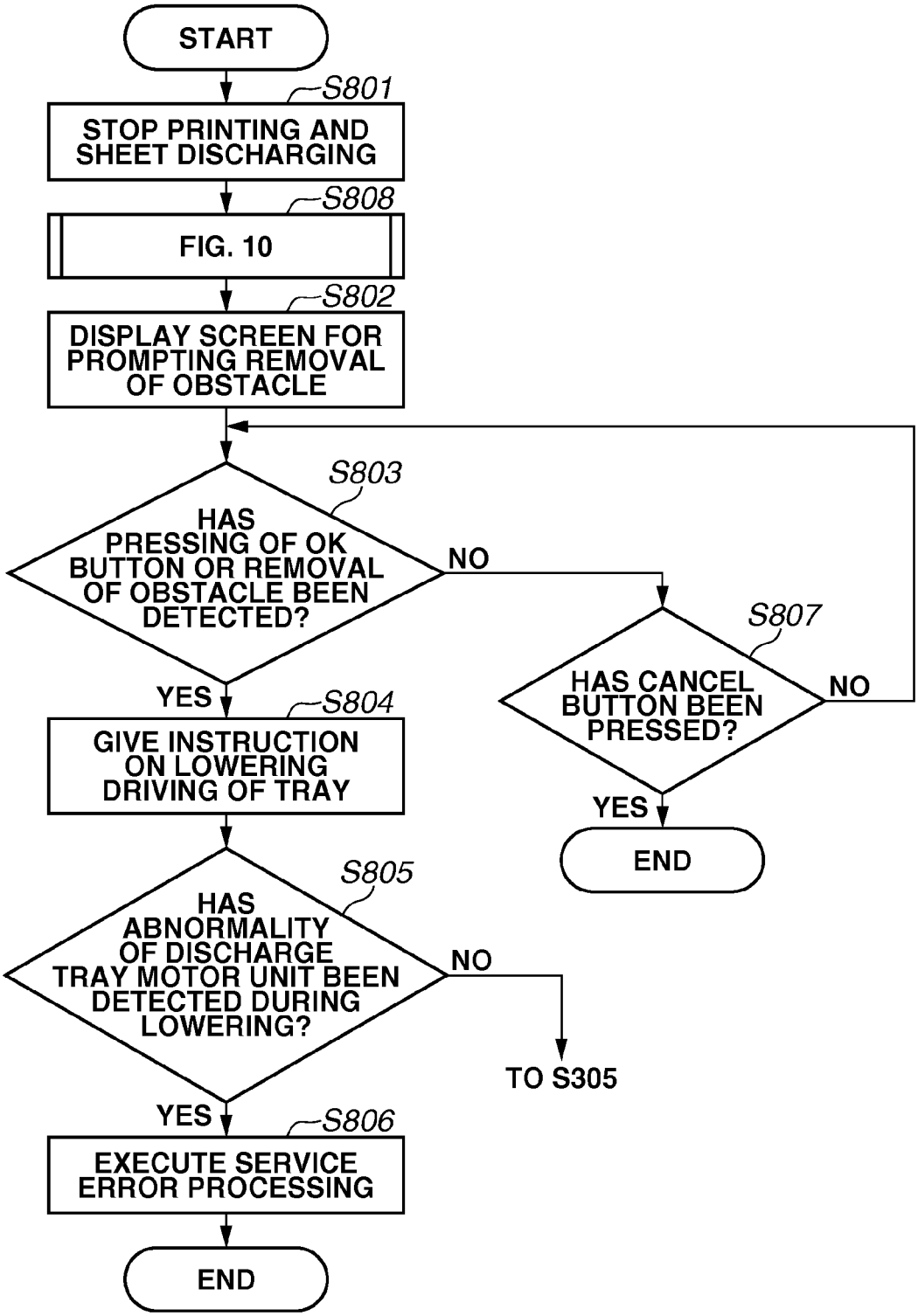
FIG. 8 is a flowchart illustrating the method for controlling the printing apparatus.

FIG. 8 is a flowchart illustrating the method for controlling the printing apparatus according to the present exemplary embodiment. This is a processing example executed when the CPU 102 determines that removal of the obstacle is necessary in step S308 illustrated in FIG. 3. This processing is carried out because it is determined that none of the printed sheets or not even one bundle can be discharged to the discharge tray 233. Each step is achieved by executing a control program stored in the ROM or the like by the CPU 102. In step S801, when the CPU 102 determines that removal of the obstacle located in the space below the discharge tray 233 is necessary, the CPU 102 instructs the printer unit 108 to stop the printing and the sheet discharging operation. Then, the CPU 102 proceeds to a flowchart illustrated in FIG. 10, and in step S808, the CPU 102 gives an instruction to raise the discharge tray 233.

Figure 9:
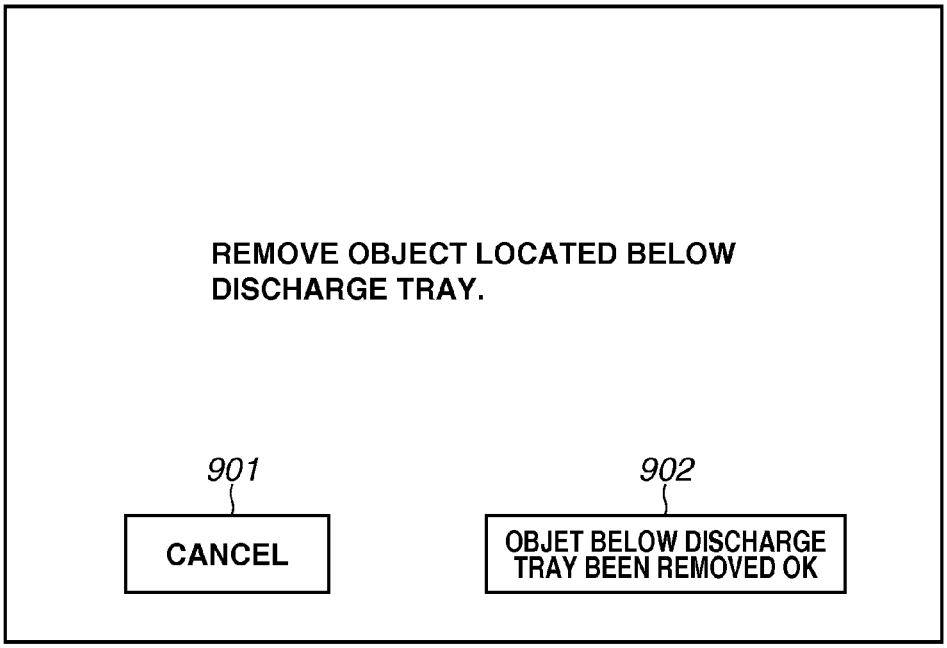
FIG. 9 is a diagram illustrating an example of the UI screen displayed on the operation unit illustrated in FIG. 1.

Then, in step S802, the CPU 102 controls the operation unit 104 to display the user interface screen for displaying, to the user, the removing of the obstacle below the discharge tray 233. FIG. 9 is a diagram illustrating an example of the UI screen displayed on the operation unit 104 illustrated in FIG. 1. This UI screen is an example of the user interface screen displayed in step S802, on which a cancel button 901 and a remove button 902 are shown.

In step S803, when the CPU 102 determines that the user has removed the obstacle located in the space below the discharge tray 233, the obstacle removal is detected by the obstacle detection sensor 238. When the CPU 102 determines that the obstacle removal has been detected (YES in step S803), in step S804, the CPU 102 gives an instruction to lower the discharge tray 233. When a finisher is connected on which the obstacle detection sensor 238 is not mounted, the user presses the remove button 902 on the user interface screen displayed in step S802. Then, in step S804, when the CPU 102 determines that the pressing of the remove button 902 has been detected, the CPU 102 gives an instruction to lower the discharge tray 233.

When the CPU 102 determines that motor abnormality has been detected again after an instruction to lower the discharge tray 233 has been given (YES in step S805), in step S806, the CPU 102 determines that there is an error in the sheet discharging unit 111 illustrated in FIG. 1 to execute service error processing, and the processing is ended. On the other hand, when the CPU 102 determines that no motor abnormality has been detected (NO in step S805), printed sheets are discharged to the discharge tray 233. The CPU 102 ends the processing and returns to step S305. On the other hand, when the CPU 102 determines that the user has pressed the cancel button 901 on the user interface screen displayed in step S802 (YES in step S807), the CPU 102 cancels the print job to end the processing.

Figure 10:
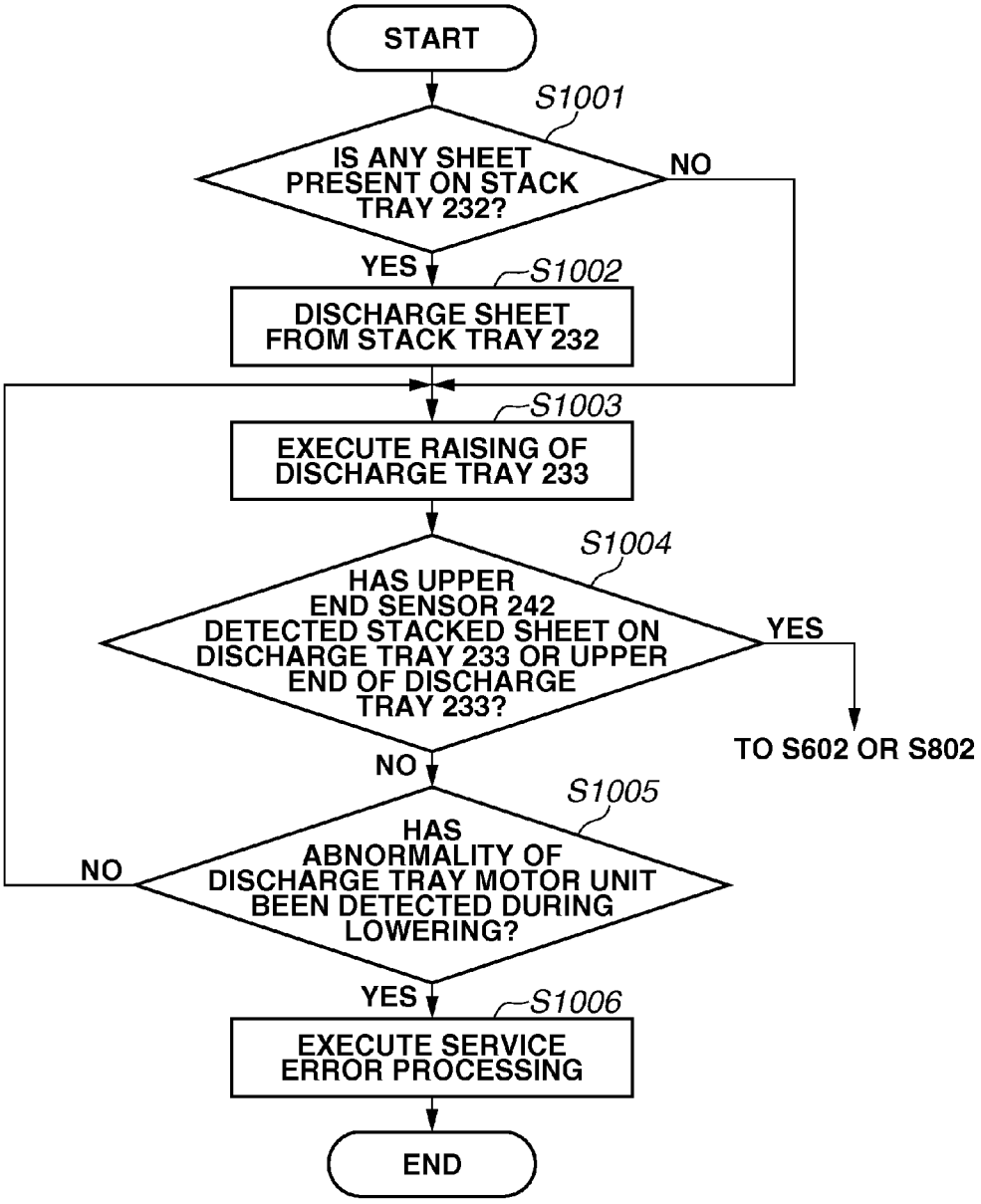
FIG. 10 is a flowchart illustrating the method for controlling the printing apparatus.
Figure 11A:
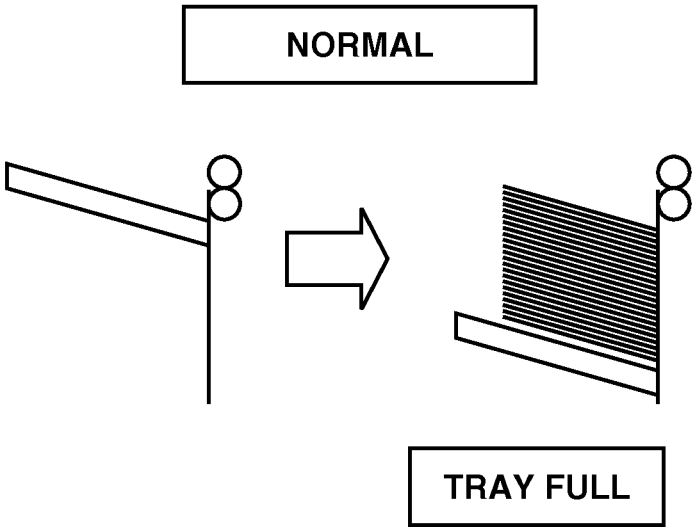
FIGS. 11A and 11B are diagrams each illustrating a relationship between a discharge tray and an obstacle.
Figure 11B:
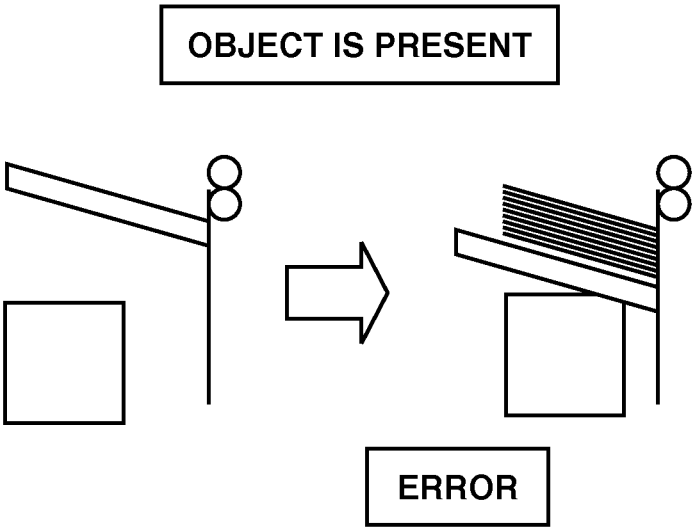

FIG. 10 is a flowchart illustrating the method for controlling the printing apparatus according to the present exemplary embodiment. This is a raising processing example of the discharge tray 233 after the detection of obstacle that is executed in step S808 illustrated in FIG. 8. Each step is achieved by executing a control program stored in the ROM or the like by the CPU 102. The processing illustrated in FIG. 10 is executed after the printing or the discharging in step S601 or S801 corresponding to the control program illustrated in FIG. 6 or 8 is stopped.

In step S1003, the CPU 102 determines that an obstacle is present below the discharge tray 233, and the CPU 102 gives an instruction to raise the discharge tray 233 such that the user can easily remove the obstacle. However, when the printing or the discharging is stopped during predetermined post-processing such as stapling or shifting, sheets may be stored in the stack tray 232. When the discharge tray is raised in this state, the sheets on the processing tray may be damaged to be unuseful as products. Thus, in step S1001, the CPU 102 detects the presence of sheets on the stack tray 232 by the stack sensor 243 for detecting the sheets on the stack tray 232. When present (YES in step S1001), in step S1002, the sheets on the stack tray 232 are discharged to the discharge tray 233.

Then, in step S1003, the CPU 102 gives an instruction to raise the discharge tray 233. In step S1004, the CPU 102 that has given an instruction to raise the discharge tray 233 determines whether the sheets stacked on the discharge tray 233 or the discharge tray 233 has reached the upper end sensor 242. This means, as described above referring to FIG. 2, that the upper end is detected by little rising when a great volume of sheets is stacked on the discharge tray 233, and when no sheet is present on the discharge tray 233, the upper end is detected at a point of time when the discharge tray 233 reaches the upper end sensor 242. When the CPU 102 determines that the sheets stacked on the discharge tray 233 or the discharge tray 233 has reached the upper end sensor 242 (YES in step S1004), the processing proceeds to step S602 or S802, and the CPU 102 continues the processing in the flowchart illustrated in FIG. 6 or 8.

On the other hand, when the CPU 102 determines that the sheets stacked on the discharge tray 233 or the discharge tray 233 has not reached the upper end sensor 242 (NO in step S1004), the processing proceeds to step S1005, and the CPU 102 determines whether the abnormality of the motor unit has been detected during rising. When the CPU 102 determines that no abnormality of the motor unit has been detected during rising (NO in step S1005), the processing proceeds to step S1003, and the CPU 102 continues the raising of the discharge tray 233. On the other hand, when the CPU 102 determines that the abnormality of the motor unit has been detected during the rising (YES in step S1005), in step S1006, the CPU 102 executes service error processing, and then the processing is ended. According to the present exemplary embodiment, even when the obstacle is located below the discharge tray 233, and the discharge tray 233 cannot be lowered due to the obstacle during the printing, the print processing can be stopped, and the printing can be resumed by user's removal of the sheets or the obstacle.

In the present exemplary embodiment, in step S1003, the discharge tray 233 is raised until it is detected by the upper end sensor 242. However, the present invention is not limited to this example. The discharge tray 233 may be raised by a predetermined height (10 cm or the like). When the discharge tray 233 is raised by the predetermined height, if the discharge tray 233 reaches the upper end sensor 242, the rising of the discharge tray 233 may be stopped at a position where it is detected by the upper end sensor 242. The discharge tray 233 may be raised by a height designated by the user in advance before sheet discharging is started. Similarly, in this case, when the discharge tray 233 is raised by the height designated by the user, if the discharge tray reaches the upper end sensor 242, the rising of the discharge tray 233 may be stopped at a position where it is detected by the upper end sensor 242. The discharge tray 233 may be raised by receiving a user's raising instruction after the lowering of the discharge tray 233 has been disabled. The discharge tray 233 may be raised by a height designated by a received user's instruction after the lowering of the discharge tray 233 has been disabled.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-246173 filed Nov. 28, 2013, which is hereby incorporated by reference herein in its entirety.

What is claimed is:

1. A sheet stacking apparatus comprising:

a lowering control unit configured to lower a discharge tray based on an amount of sheets discharged to the discharge tray;

a determination unit configured to determine that lowering of the discharge tray has been disabled before the discharge tray reaches a lower end position;

a notification unit configured to notify removal of an object present below the discharge tray when it is determined that the lowering of the discharge tray has been disabled;

a control unit configured to execute control to raise the discharge tray in response to the determination that the lowering of the discharge tray has been disabled; and a reception unit configured to receive an instruction for notifying the removal of the object to the sheet stacking apparatus by a user, wherein the control unit executes control to further lower the discharge tray after the instruction has been received.

2. The sheet stacking apparatus according to claim 1, wherein, when it is determined that the lowering of the discharge tray has been disabled, the notification unit further notifies removal of the sheets discharged to the discharge tray.

3. The sheet stacking apparatus according to claim 1, wherein, when it is determined that the lowering of the discharge tray has been disable, the control unit executes control to raise the discharge tray by a height designated by a user.

4. A sheet stacking apparatus comprising:

a lowering control unit configured to lower a discharge tray based on an amount of sheets discharged to the discharge tray;

a determination unit configured to determine that lowering of the discharge tray has been disabled before the discharge tray reaches a lower end position;

a notification unit configured to notify removal of an object present below the discharge tray when it is determined that the lowering of the discharge tray has been disabled;

a control unit configured to execute control to raise the discharge tray in response to the determination that the lowering of the discharge tray has been disabled; and a confirmation unit configured to confirm whether the sheets discharged to the discharge tray are removed, wherein, after the confirmation unit has confirmed that the sheets are removed, the control unit executes control to further raise the discharge tray.

5. A method for controlling a sheet stacking apparatus, the method comprising:

lowering a discharge tray based on an amount of sheets discharged to the discharge tray;

determining that lowering of the discharge tray has been disabled before the discharge tray reaches a lower end position;

notifying removal of an object present below the discharge tray when it is determined that the lowering of the discharge tray has been disabled;

executing control to raise the discharge tray in response to the determination that the lowering of the discharge tray has been disabled; and receiving an instruction for notifying the removal of the object to the sheet stacking apparatus by a user, wherein executing control includes executing control to further lower the discharge tray after the instruction has been received.

6. A non-transitory computer readable storage medium storing a program for causing a computer to execute a method for controlling a sheet stacking apparatus, the method comprising:

lowering a discharge tray based on an amount of sheets discharged to the discharge tray;

determining that lowering of the discharge tray has been disabled before the discharge tray reaches a lower end position;

notifying removal of an object present below the discharge tray when it is determined that the lowering of the discharge tray has been disabled;

executing control to raise the discharge tray in response to the determination that the lowering of the discharge tray has been disabled; and receiving an instruction for notifying the removal of the object to the sheet stacking apparatus by a user, wherein executing control includes executing control to further lower the discharge tray after the instruction has been received.

7. A method for controlling a sheet stacking apparatus, the method comprising:

lowering a discharge tray based on an amount of sheets discharged to the discharge tray;

determining that lowering of the discharge tray has been disabled before the discharge tray reaches a lower end position;

notifying removal of an object present below the discharge tray when it is determined that the lowering of the discharge tray has been disabled;

executing control to raise the discharge tray in response to the determination that the lowering of the discharge tray has been disabled; and confirming whether the sheets discharged to the discharge tray are removed, wherein, after it is confirmed that the sheets are removed, executing control includes executing control to further raise the discharge tray.

8. A non-transitory computer readable storage medium storing a program for causing a computer to execute a method for controlling a sheet stacking apparatus, the method comprising:

lowering a discharge tray based on an amount of sheets discharged to the discharge tray;

determining that lowering of the discharge tray has been disabled before the discharge tray reaches a lower end position;

notifying removal of an object present below the discharge tray when it is determined that the lowering of the discharge tray has been disabled;

executing control to raise the discharge tray in response to the determination that the lowering of the discharge tray has been disabled; and confirming whether the sheets discharged to the discharge tray are removed, wherein, after it is confirmed that the sheets are removed, executing control includes executing control to further raise the discharge tray.

* * * * *